US010781082B2

(12) United States Patent
Chen et al.

(10) Patent No.: US 10,781,082 B2
(45) Date of Patent: Sep. 22, 2020

(54) PORTABLE DISTRIBUTION TRANSFORMER HOISTING RACK

(71) Applicant: Zhejiang Tailun Power Group Co., Ltd., Zhejiang (CN)

(72) Inventors: Zhen Chen, Zhejiang (CN); Keqin Ye, Zhejiang (CN); Jing Xu, Zhejiang (CN); Shiyue Qin, Zhejiang (CN); Wenhui Xu, Zhejiang (CN); Xinhang Chen, Zhejiang (CN); Jianping Xu, Zhejiang (CN); Shijun Chen, Zhejiang (CN); Tianyuan Guo, Zhejiang (CN); Xinlong Wu, Zhejiang (CN); Feng Lv, Zhejiang (CN)

(73) Assignee: Zhejiang Tailun Power Group Co., Ltd., Zheijiang (CN)

( * ) Notice: Subject to any disclaimer, the term of this patent is extended or adjusted under 35 U.S.C. 154(b) by 138 days.

(21) Appl. No.: 16/234,588

(22) Filed: Dec. 28, 2018

(65) Prior Publication Data

US 2019/0233260 A1 Aug. 1, 2019

(30) Foreign Application Priority Data

Jan. 26, 2018 (CN) ..... 2018 2 0141554 U

(51) Int. Cl.
*B66C 23/20* (2006.01)
*H01F 27/06* (2006.01)

(52) U.S. Cl.
CPC ..... *B66C 23/203* (2013.01); *H01F 27/06* (2013.01)

(58) Field of Classification Search
CPC ..... B66C 23/18; B66C 23/20; B66C 23/203; H01F 27/06; F16M 13/02; H02B 3/00
USPC ..... 248/228.4, 230.4, 231.51, 286.1; 52/127.1, 127.2, 651.05
See application file for complete search history.

(56) References Cited

U.S. PATENT DOCUMENTS 548,422 A * 10/1895 Beardsley ..... A24F 19/0092 248/230.4
1,547,915 A * 7/1925 Hirn ..... B66C 23/203 52/40
2,153,803 A * 4/1939 Jerabek ..... B66C 23/203 212/179
3,136,519 A * 6/1964 Spriggle ..... B66C 23/203 248/230.8

(Continued)

FOREIGN PATENT DOCUMENTS

CN 205282958 6/2016

*Primary Examiner* — Michael R Mansen
*Assistant Examiner* — Juan J Campos, Jr.
(74) *Attorney, Agent, or Firm* — JCIPRNET

(57) ABSTRACT

The present disclosure relate to an improved portable distribution transformer hoisting rack, comprising a loose-leaf hold hoop, a fixed hold hoop, a supporting rod, and a length-adjustable adjusting rod, wherein: the loose-leaf hold hoop includes a first hold hoop, a second hold hoop, and a third hold hoop, the third hold hoop being disposed between the first hold hoop and the second hold hoop; one end of the supporting rod being rotatably connected to the third hold hoop; the other end of the supporting rod being provided with a hoisting assembly, one end of the adjusting rod being movably connected to the supporting rod, and the other end of the adjusting rod being movably connected to the fixed hold hoop.

10 Claims, 5 Drawing Sheets

(56) References Cited

U.S. PATENT DOCUMENTS

| | | | | |
|---|---|---|---|---|
| 6,138,964 | A * | 10/2000 | Rose | F16M 11/2014 248/123.11 |
| 6,663,065 | B1 * | 12/2003 | Whittenburg | B66C 23/203 182/187 |
| 6,983,856 | B1 * | 1/2006 | Burks | B66C 23/20 212/179 |
| 7,341,507 | B1 * | 3/2008 | Julian, Sr. | A22B 5/06 452/192 |
| 8,062,106 | B1 * | 11/2011 | Adams, III | A01K 5/0291 452/189 |
| 10,112,806 | B1 * | 10/2018 | Dahl | B66C 23/64 |

* cited by examiner

PORTABLE DISTRIBUTION TRANSFORMER HOISTING RACK

CROSS-REFERENCE TO RELATED APPLICATION

This application claims the priority benefit of China application serial no. 201820141554.7, filed on Jan. 26, 2018. The entirety of the above-mentioned patent application is hereby incorporated by reference herein and made a part of this specification.

FIELD

Embodiments of the present disclosure generally relate to an improved Portable distribution transformer hoisting rack.

BACKGROUND

In an electric power system, there are multifarious approaches of hoisting a pole-mounted distribution transformer apparatus due to restraints by conditions such as terrain environment, procedures and standards during an overhaul work which needs to hoist a relatively ponderous transformer and switch cabinet; due to many restraints such as terrain and transportation conditions as well as a long time consumed by combined tools, the hoisting work needs assistance from a forklift and a crane, which costs highly and takes much time. The Chinese patent application No. 2016200394722 discloses a portable distribution transformer hoisting frame, wherein when mounting, a supporting rod is fixed to a mast via a loose-leaf hold hoop and a fixed hold hoop, the loose-leaf hold hoop including two symmetrically arranged hold hoop bodies, each hold hoop body including an arcuate hoop portion and two fastening portions of a plate shape disposed respectively at two ends of the hoop portion, wherein the two opposite fastening portions are fixed via bolts. However, in this patent application, the loose-leaf hold hoop has a strenuous mounting and dismounting process, and when one of the two fastening portions is loosened, the loose-leaf hold hoop easily slides on the mast; therefore, it has a poor safety performance and is demanding on mounting operators.

SUMMARY

An object of the present disclosure to provide an improved portable distribution transformer hoisting rack so as to solve the technical problem of the overall strenuous mounting process of the portable distribution transformer hoisting rack caused by a loose-leaf hold hoop.

To solve the technical problem above, the present disclosure is implemented by the following technical solution: an improved portable distribution transformer hoisting rack, comprising: a loose-leaf hold hoop, a fixed hold hoop, a supporting rod, and a length-adjustable adjusting rod, wherein the loose-leaf hold hoop includes a first hold hoop, a second hold hoop, and a third hold hoop, the third hold hoop being disposed between the first hold hoop and the second hold hoop; the third hold hoop includes a first mounting portion and a second mounting portion, one end of the first hold hoop being mounted on the third hold hoop via the first mounting portion; a first gap is provided between the first hold hoop and the third hold hoop, one end of the second hold hoop being mounted on the third hold hoop via the second mounting portion; a second gap is provided between the second hold hoop and the third hold hoop; a first bolt assembly is provided between the other end of the first hold hoop and the other end of the second hold hoop, one end of the supporting rod being rotatably connected to the third hold hoop; the other end of the supporting rod being provided with a hoisting assembly for hoisting the power equipment, one end of the adjusting rod being movably connected to the supporting rod, and the other end of the adjusting rod being movably connected to the fixed hold hoop.

Preferably, the first mounting portion is a first mounting plate provided on the third hold hoop, a first fixing plate being provided on the first hold hoop, the first hold hoop being fixedly connected to the first mounting plate via the first fixing plate; and the second mounting portion is a second mounting plate provided on the third hold hoop, the second fixing plate being provided on the second hold hoop, the second hold hoop being fixedly connected to the second mounting plate via the second fixing plate.

Preferably, a radian of the first gap is equal to a radian of the second gap, and a central angle of the third hold hoop is 35-40°.

Preferably, a connecting bolt about which the supporting rod rotates is provided on the third hold hoop.

Preferably, the adjusting rod comprises a body and an angular linkage, one end of the body being movably connected to the supporting rod, the other end of the body being connected to the fixed hold hoop via the angular linkage.

Preferably, the body comprises: an adjusting portion, a first movable rod, and a second movable rod, the first movable rod being connected to one end of the adjusting portion via a positive thread, the second movable rod being connected to the other end of the adjusting portion via a negative thread.

Preferably, the adjusting portion comprises a tube body of a hollow structure, wherein one end of the tube body is provided with a positive thread hole, a positive thread fitted with the positive thread hole being provided on the first movable rod; the other end of the tube body is provided with a negative thread hole, a negative thread fitted with the negative thread hole being provided on the second movable rod; and the adjusting portion further comprises a nut facilitating the tube body to rotate, the nut being integrally formed with the tube body.

Preferably, the angular linkage including a steering head, a change-over board, and a D-shaped shackle, one end of the steering head being movably connected with the fixed hold hoop, the other end thereof being provided with a limit groove, one end of the change-over board being rotatably connected in the limit groove, the other end of the change-over board being provided with a bar-shaped hole for the D-shackle to move; and a connecting ring connected to the D-shaped shackle is provided on the first movable rod, the connecting ring and the first movable rod being of an integral structure.

Preferably, the hoisting assembly comprises a lifting u-shaped ring and an electric hoist disposed on the lifting u-shaped ring, the lifting u-shaped ring being detachably connected with the supporting rod, a tension sensor being provided on the lifting u-shaped ring.

Preferably, a fixed shaft is provided on the supporting rod, a fixed sleeve is provided on the lifting u-shaped ring, an eccentric hole is provided in the fixed sleeve, a locking screw is provided on the fixed sleeve, and a bottom end of the locking screw is provided with a magnet for pulling-in the fixed shaft, the fixed shaft being mounted in the fixed sleeve via the locking screw.

In view of the above, the present disclosure has the following advantages: 1. The third hold hoop provided between the first hold hoop and the second hold hoop enables the entire loose-leaf hold hoop to be mounted on the mast only by tightly screwing the first hold hoop and the second hold hoop via the first bolt assembly, which simplifies a mounting process of the loose-leaf hold hoop, improves the flexibility of hold hoop mounting, may avoid relative sliding between the loose-leaf hold hoop and the mast, may increase a contact area between the loose-leaf hold hoop and the mast, and may guarantee a close fitting between the loose-leaf hold hoop and the mast with a large supporting area and a high safety performance. Besides, by mounting one end of the first hold hoop to the third hold hoop via the first mounting portion and mounting one end of the second hold hoop to the third hold hoop via the second mounting portion, the first hold hoop, the second hold hoop, and the third hold hoop may form an organic whole, which enhances the overall strength of the loose-leaf hold hoop and facilitates mounting and dismounting; providing of the first gap and the second gap improves the clamping force with respect to the mast when the first hold hoop and the second hold hoop are tightly locked and further improves the fixing effect of the loose-leaf hold hoop. By rotatably connecting one end of the supporting rod to the third hold hoop and providing a hoisting assembly for hoisting the power equipment at the other end of the supporting rod, the horizontal position of the supporting rod may be adjusted according to different hoisting environments, and the vertical position of the supporting rod may be adjusted by adjusting the vertical position based on the length of the adjusting rod; in this way, the entire distribution transformer rack may satisfy different operating environments, thereby providing a good practicality;

2. By setting the first mounting portion as the first mounting plate and fitting the first mounting plate with the first fixing plate provided on the first hold hoop, the first hold hoop may be quickly fastened to the third hold hoop; by setting the second mounting portion as the second mounting plate and fitting the second mounting plate with the second fixing plate provided on the second hold hoop, the second hold hoop may be quickly and stably fixed to the third hold hoop, thereby achieving a flexibility for mounting the entire hold hoop;

3. Setting the radian of the first gap to be equal to that of the second gap enables the first hold hoop and the second hold hoop to have a same movement freedom when being mounted, which may guarantee the steadiness of the entire loose-leaf hold hoop, improve the mounting stability, and further improve the clamping force of mounting the loose-leaf hold hoop to the mast; setting the central angle corresponding to the third hold hoop to 35°-45° facilitates the integral machining of the third hold hoop and improves the overall strength of the third hold hoop, because when the central angle is smaller than 35°, the third hold hoop is easily loosened when mounting, while when the central angle is larger than 40°, it is inconvenient for integral machining, which would otherwise raise the machining cost;

4. Providing of the connecting bolt may implement a fast connection between the supporting rod and the third hold hoop, which facilitates mounting and dismounting;

5. By adjusting the angle between the adjusting rod and the fixed hold hoop using an angular linkage, the flexibility of the entire mounting is improved, such that the adjusting linkage may implement a fast adjustment and mounting based on different environments, which enhances mounting efficiency and also enhances the operation safety performance.

6. By setting the adjusting rod to include an adjusting portion, a first movable rod, and a second movable rod, providing the first movable rod and the second movable rod on the adjusting portion using a positive thread and a negative thread, and controlling the connection lengths of the positive thread and the negative thread using rotation of the adjusting portion to control moving up/down of the first movable rod and the second movable rod inside the adjusting portion, the moving up/down of the entire adjusting rod is implemented, which facilitates the adjustment with a high sensitivity; the connection with the positive thread and the negative thread provides a reliable mounting and may achieve a synchronous movement of the first movable rod and the second movable rod, thereby enhancing the adjustment efficiency.

7. The moving up/down of the first movable rod inside the tube body is implemented through a rotating direction of the positive thread in the positive thread hole, and the moving up/down of the second movable rod inside the tube body is implemented through the rotating direction of the negative thread in the negative thread hole; the stability of adjusting the entire length of the adjusting rod may be realized with a reliable thread connection and a convenient mounting and dismounting; setting of the nut facilitates an operator to rotate the tube body, which improves the operation convenience; besides, by integrally setting the nut and the tube body, the connection strength between the nut and the tube body may be enhanced, which prevents the nut from being released or loosened during use, thereby enhancing the operation safety performance and simplifying the nut mounting process.

8. By setting the angular linkage to include a Steering head, a change-over board, and a D-shaped shackle, the entire linkage is easily mounted and dismounted and the connection is reliable; setting of the limit groove may effectively limit the movable angle of the change-over board on the steering head, which enhances the safety performance of use as a whole and may also improve the service life of the whole; the D-shaped shackle may implement a movable connection between the first movable rod and the change-over board, and the movement of the D-shaped shackle is implemented through the bar-shaped hole provided on the change-over plate, such that when the first movable rod moves up or down, it may simultaneously drive movement of the D-shaped shackle on the change-over board, thereby implementing adjustment of the angle between the first movable rod and the change-over board, which enables a convenient adjustment and a reliable connection; besides, setting of the connection ring enables a fast assembly between the first movable rod and the D-shaped shackle, which facilitates mounting and dismounting with a good use effect; setting the connection ring and the first movable rod into an integral structure may enhance the strength of the entirety, simplify the mounting process of the connection ring, and prevent detachment of the connection ring from the first movable rod when use, thereby enhancing safety performance.

9. The hoisting assembly is set to include a lifting u-shaped ring and an electric hoist. By mounting the electric hoist onto the supporting rod via the lifting u-shaped ring so as to hoist the power equipment via the electric hoist, the hoisting efficiency is high; setting of the tension sensor enables a real-time detection of the weight of the power equipment so as to prevent the supporting rod from being broken due to a too heavy weight of the power equipment, which further improves the safety performance; and by setting the lifting u-shaped ring and the supporting rod to be a detachable connection, it facilitates the operators to carry, thereby enabling on-site assembly, thereby providing a good practicality.

10. Through fitting between the fixed shaft and the eccentric hole inside the fixed sleeve, the lifting u-shaped ring may be quickly mounted on the supporting rod; the eccentric ring enables a fast mounting of the fixed shaft and facilitates dismounting of the lifting u-shaped ring; the magnet on the locking screw pulls in the fixed shaft, causing the lifting u-shaped ring to be tightened to the fixed shaft, which prevents detachment of the lifting u-shaped ring from the fixed shaft during the hoisting procedure and thereby improves the operating safety performance; besides, by providing the locking screw on the fixed sleeve via the magnet, pull-in and separation between the magnet and the fixed shaft may be quickly realized, such that the mounting process is simple, the use effect is good, and the pull-in steadiness between the magnet and the fixed shaft can be guaranteed.

BRIEF DESCRIPTION OF THE DRAWINGS

Hereinafter, the present disclosure will be described in further detail with reference to the accompanying drawings.

REFERENCE NUMERALS

Figure 1:
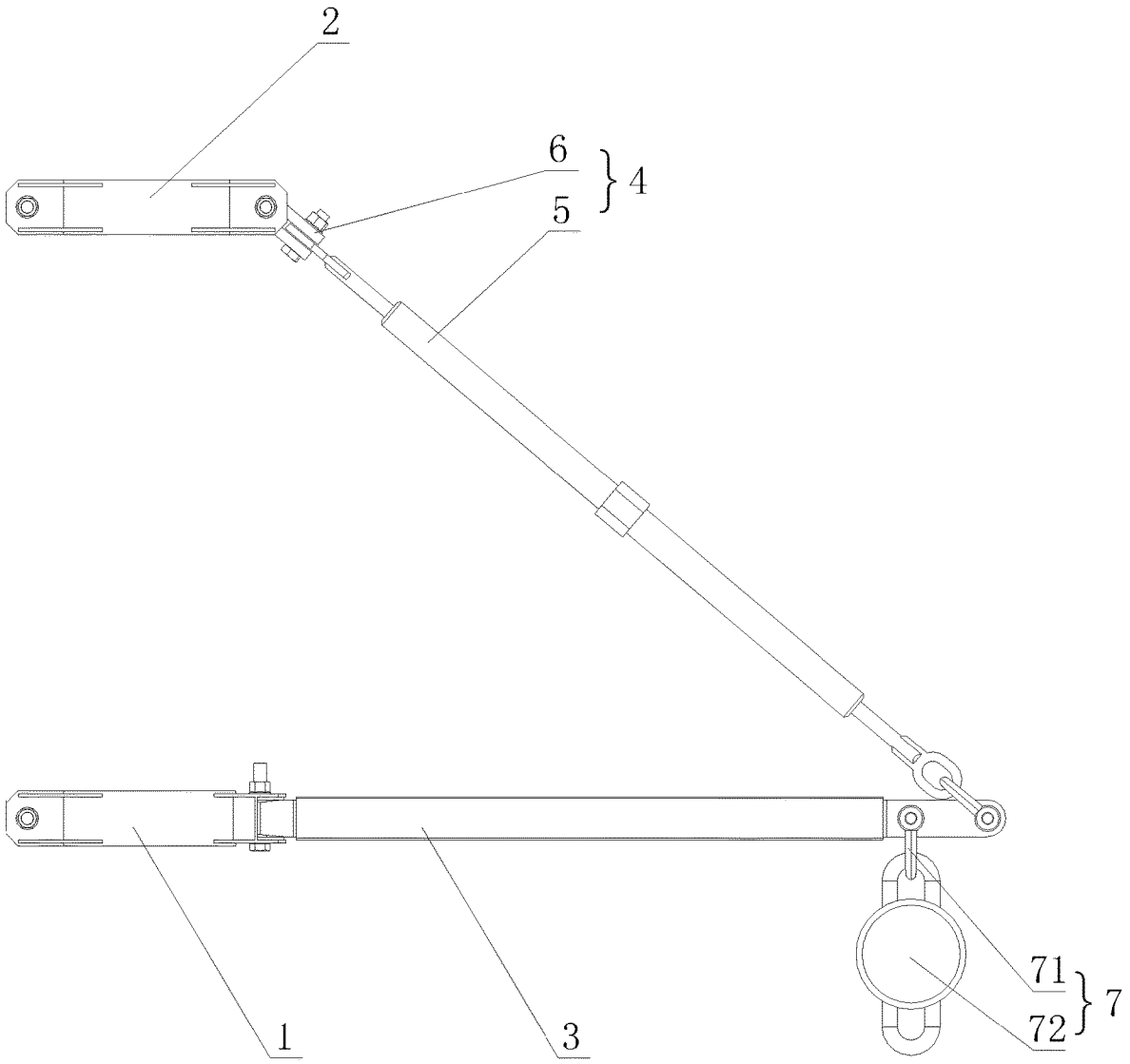
FIG. 1 is a structural schematic diagram of an improved portable distribution transformer hoisting rack of the present disclosure.
Figure 2:
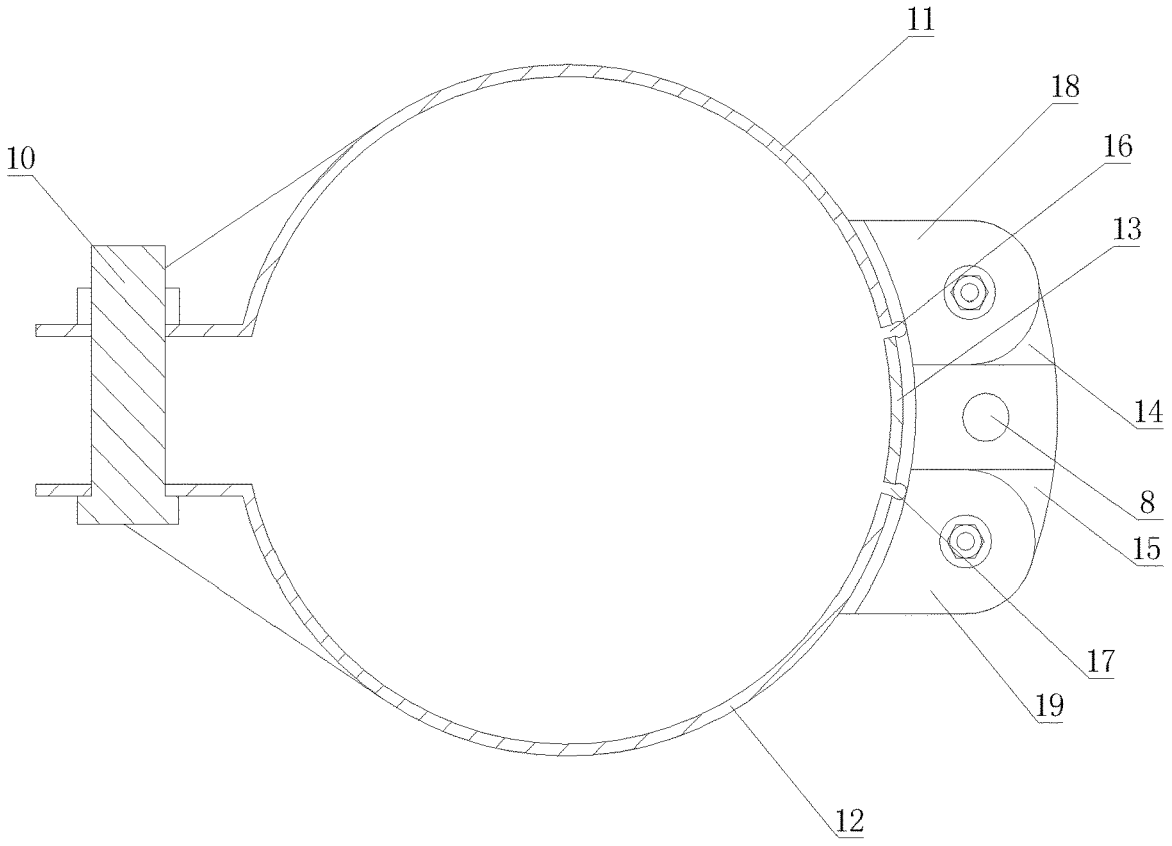
FIG. 2 is a structural schematic diagram of a loose-leaf hold hoop of the present disclosure.
Figure 3:
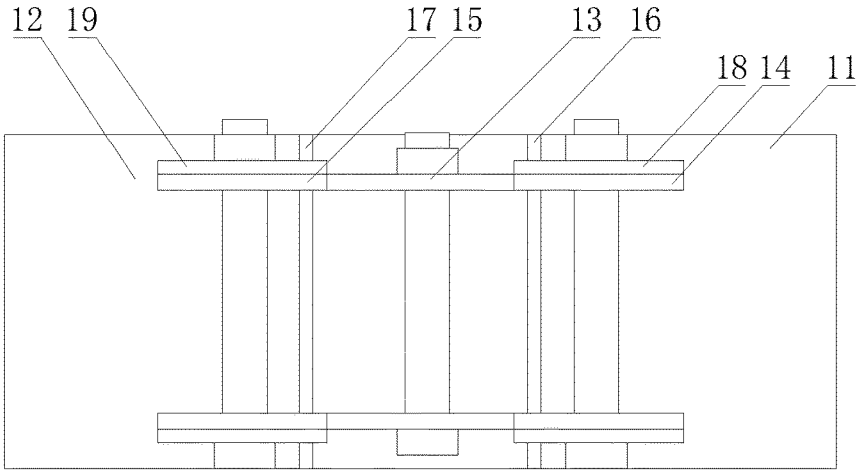
FIG. 3 is a right-side view of FIG. 2.
Figure 4:
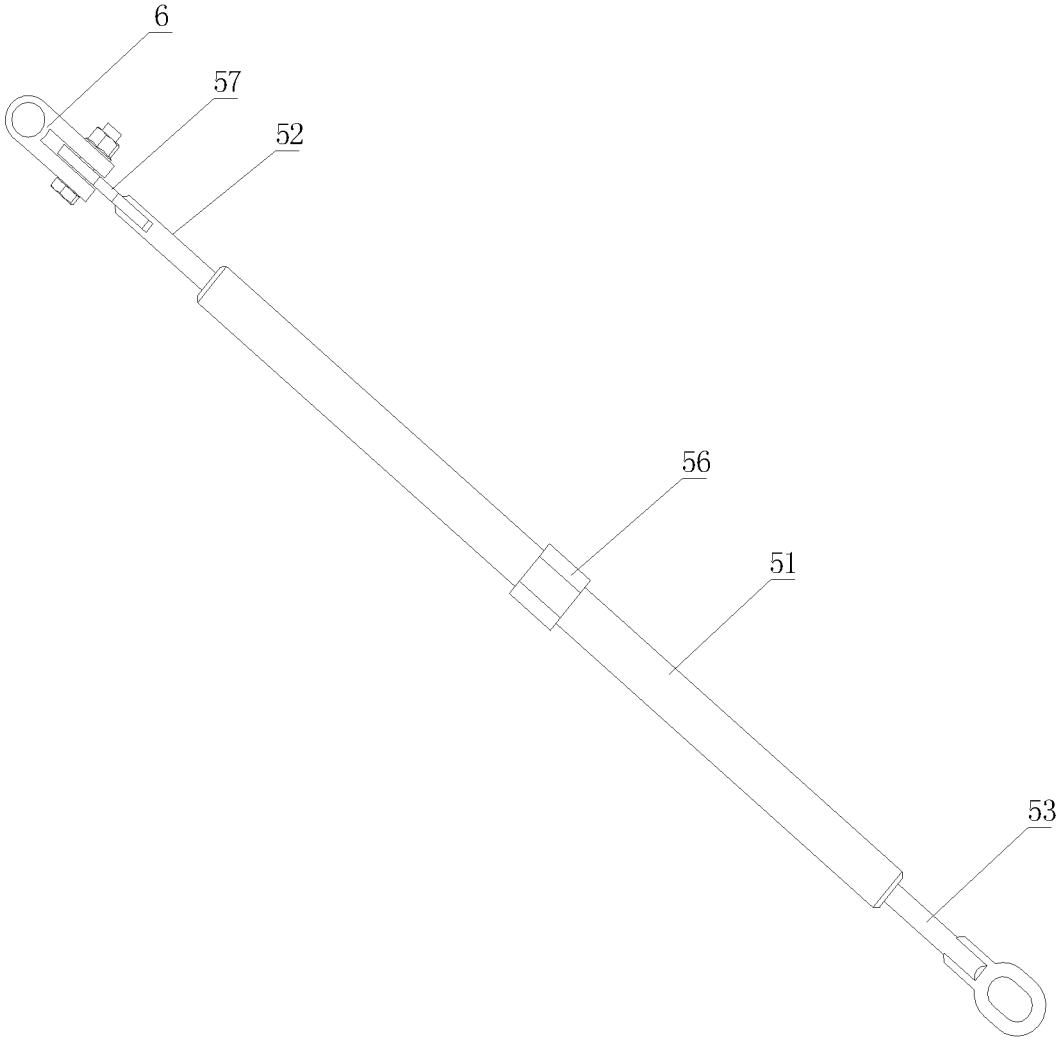
FIG. 4 is a structural schematic diagram of an adjusting rod of the present disclosure.
Figure 5:
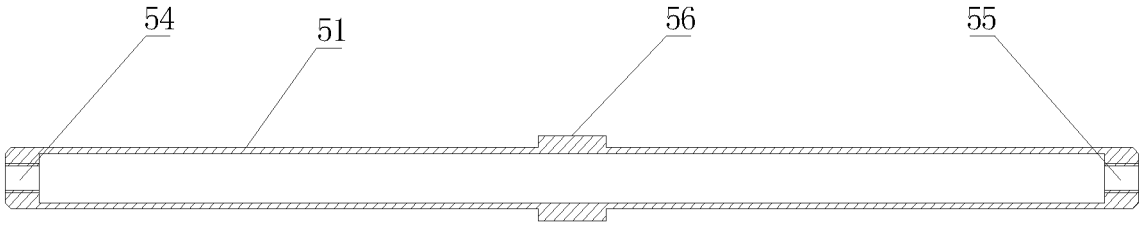
FIG. 5 is a structural schematic diagram of a body of the present disclosure.

1. Loose-leaf hold hoop; 10. First bolt assembly; 11. First hold hoop; 12. Second hold hoop; 13. Third hold hoop; 14. First mounting portion; 15. Second mounting portion; 16. First gap; 17. Second gap; 18. First fixing plate; 19. Second fixing plate; 2. Fixed hold hoop; 3. Supporting rod; 31. Supporting cross bar; 32. First connecting rod; 33. Second connecting rod; 34. Fixed shaft; 4. Adjusting rod; 5. Body; 51. Adjusting portion; 52. First movable rod; 53. Second movable rod; 54. Positive thread hole; 55. Negative thread hole; 56. Nut; 57. Connecting ring; 6. Angular linkage; 61. Steering head; 62. Change-over board; 63. Second bolt assembly; 64. Limit groove; 65. D-shaped shackle; 66. Bar-shaped hole; 7. Hoisting assembly; 70. Tension sensor; 71. Lifting u-shaped ring; 72. Electric hoist; 73. Fixed sleeve; 74. Eccentric hole; 75. Locking screw; 76. Magnet; 8. Connecting bolt.

DETAILED DESCRIPTION OF EMBODIMENTS

As shown in FIGS. 1-9, an improved portable distribution transformer hoisting rack comprises: a loose-leaf hold hoop 1, a fixed hold hoop 2, a supporting rod 3, and a length-adjustable adjusting rod 4, wherein the loose-leaf hold hoop 1 comprises a first hold hoop 11, a second hold hoop 12, and a third hold hoop 13, the third hold hoop 13 being provided between the first hold hoop 11 and the second hold hoop 12; the third hold hoop 13 comprises a first mounting portion 14 and a second mounting portion 15, one end of the first hold hoop 11 being mounted onto the third hold hoop 13 via the first mounting portion 15; a first gap 16 is provided between the first hold hoop 11 and the third hold hoop 13, one end of the second hold hoop 12 being mounted on the third hold hoop 13 via the second mounting portion 15; a second gap 17 is provided between the second hold hoop 12 and the third hold hoop 13; a first bolt assembly 10 is provided between the other end of the first hold hoop 11 and the other end of the second hold hoop 12, one end of the supporting rod 3 being rotatably connected to the third hold hoop 13, the other end of the supporting rod being provided with a hoisting assembly 17 for hoisting power equipment, one end of the adjusting rod 4 being movably connected to the supporting rod 3, the other end of the adjusting rod 4 being movably connected to the fixed hold hoop 2; when mounting, the third hold hoop 13 provided between the first hold hoop 11 and the second hold hoop 12 enables the entire loose-leaf hold hoop 1 to be mounted to the mast only by tightly screwing the first hold hoop 11 and the second hold hoop 12 via the first bolt assembly 10, which simplifies the mounting process of the loose-leaf hold hoop 1, improves the flexibility of hold hoop mounting, may avoid relative sliding between the loose-leaf hold hoop 1 and the mast, may increase a contact area between the loose-leaf hold hoop 1 and the mast, and may guarantee a close fitting between the loose-leaf hold hoop 1 and the mast with a large support area and a high safety performance. Besides, by mounting one end of the first hold hoop 11 to the third hold hoop 13 via the first mounting portion and mounting one end of the second hold hoop 12 to the third hold hoop 13 via the second mounting portion 12, the first hold hoop 11, the second hold hoop 12, and the third hold hoop 13 may form an organic whole, which enhances the overall strength of the loose-leaf hold hoop 1 and facilitates mounting and dismounting. Providing of the first gap and the second gap improves the clamping force with respect to the mast when the first hold hoop 11 and the second hold hoop 12 are tightly locked and further improves the fixing effect of the loose-leaf hold hoop 1. By rotatably connecting one end of the supporting rod 3 to the third hold hoop 13 and providing a hoisting assembly 7 for hoisting the power equipment at the other end of the supporting rod 3 enables adjustment of the horizontal position of the supporting rod 3 based on different hoisting environments, and by adjustment of the vertical position based on the length of the adjusting rod 4, the entire distribution transformer rack may satisfy different operating environments and thus has a good practicality; when the hoisting rack is used as a whole, the fixed hold hoop 2 is first mounted on the mast, and then the length of the adjusting rod 4 is adjusted based on the actual mounting environment to cause the loose-leaf hold hoop 1 to mounted to the mast; then, the power equipment is connected to the hoisting assembly 7, causing the hoisting assembly to move the power equipment up or down.

The first mounting portion is a first mounting plate provided on the third hold hoop 13, a first fixing plate 18 is provided on the first hold hoop 11, the first hold hoop 11 is fixedly connected to the first mounting plate via the first fixing plate, the second mounting portion is a second mounting plate provided on the third hold hoop 13, the second hold hoop 12 is provided with a second fixing plate 19, the second hold hoop 12 is fixedly connected to the second mounting plate via the second fixing plate. By setting the first mounting portion as the first mounting plate and fitting the first mounting plate with the first fixing plate provided on the first hold hoop 11, the first hold hoop 11 may be quickly fastened to the third hold hoop 13; by setting the second mounting portion as the second mounting plate and fitting the second mounting plate with the second fixing plate provided on the second hold hoop 12, the second hold hoop 12 may be quickly and stably fixed to the third hold hoop 13, thereby achieving a flexibility for mounting the entire hold hoop.

A radian of the first gap is equal to a radian of the second gap, and a central angle of the third hold hoop 13 is 35-40°. Setting the radian of the first gap to be equal to that of the second gap enables the first hold hoop 11 and the second hold hoop 12 to have a same movement freedom when mounting, which may guarantee the steadiness of the entire loose-leaf hold hoop, improve the mounting stability, and further improve the clamping force of mounting the hold hoop to the mast; setting the central angle corresponding to the third hold hoop 13 to 35-45° facilitates the integral machining of the third hold hoop 13 and improves the overall strength of the third hold hoop 13, because when the central angle is smaller than 35°, the hold hoop is easily loosened when mounting, while when the central angle is larger than 40°, it is inconvenient for integral machining, which would otherwise raise the machining cost.

Figure 7:
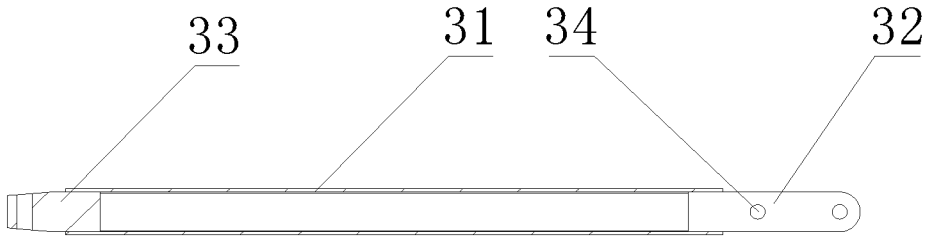
FIG. 7 is a structural schematic diagram of a supporting rod of the present disclosure.

The third hold hoop 13 is provided with a connecting bolt 8 about which the supporting rod 3 rotates, which enables a fast connection between the supporting rod 3 and the third hold hoop 13 and facilitates mounting and dismounting; as shown in FIG. 7, the supporting rod 3 in this embodiment comprises a supporting cross bar 31, a first connecting rod 32 disposed at one end of the supporting cross bar, and a second connecting rod 33 disposed at the other end of the supporting rod 3; besides, the second connecting rod 33 is connected to the connecting bolt 8. By adjusting the angle between the adjusting rod and the fixed hold hoop using an angular linkage, the flexibility of the entire mounting is improved, such that the adjusting linkage may implement a fast adjustment and mounting based on different environments, which enhances mounting efficiency and also enhances the operation safety performance.

The body 5 comprises an adjusting portion 51, a first movable rod 52, and a second movable rod 53, the first movable rod 52 being connected to one end of the adjusting portion 51 via a positive thread, the second movable rod 53 being connected to the other end of the adjusting portion 51 via a negative thread, the first movable rod 52 being connected to the angular linkage 6, the second movable rod 53 being movably connected to the second connecting rod via a D-shaped junction. The first movable rod 52 and the second movable rod 53 are movably connected to the adjusting portion 51 via the positive thread and the negative thread; by controlling the connection lengths of the positive thread and the negative thread via rotation of the adjusting portion 51 to control moving up/down of the first movable rod 52 and the second movable rod 53 inside the adjusting portion 51, the moving up/down of the entire adjusting rod 4 is implemented, which facilitates the adjustment with a high sensitivity; the positive thread and the negative thread provide a reliable connection and mounting and may implement synchronous movement of the first movable rod 51 and the second movable rod 52, thereby enhancing the adjustment efficiency.

The adjusting portion 51 comprises a tube body of a hollow structure, one end of the tube body being provided with a positive thread hole 54, the positive thread fitted with the positive thread hole 54 being provided on the first movable rod 52, the other end of the tube body being provided with a negative thread hole, a negative thread fitted with a negative thread hole 55 being provided on the second movable rod 53. The moving up/down of the first movable rod 52 inside the tube body is implemented through a rotating direction of the positive thread in the positive thread hole 54, and the moving up/down of the second movable rod 53 inside the tube body is implemented through the rotating direction of the negative thread in the negative thread hole 55; therefore, the stability of adjusting the entire length of the adjusting rod 4 may be realized with a reliable thread connection and a convenient mounting and dismounting; the adjusting portion 51 further comprises a nut 56 facilitating the tube body to rotate, the nut 56 being integrally formed with the tube body; setting of the nut 56 facilitates an operator to rotate the tube body, which improves the operation convenience; besides, by integrally setting the nut 56 and the tube body, the connection strength between the nut 56 and the tube body may be enhanced, which presents the nut 56 from being released or loosened during use, thereby enhancing the operation safety performance and simplifying the nut 56 mounting process.

Figure 6:
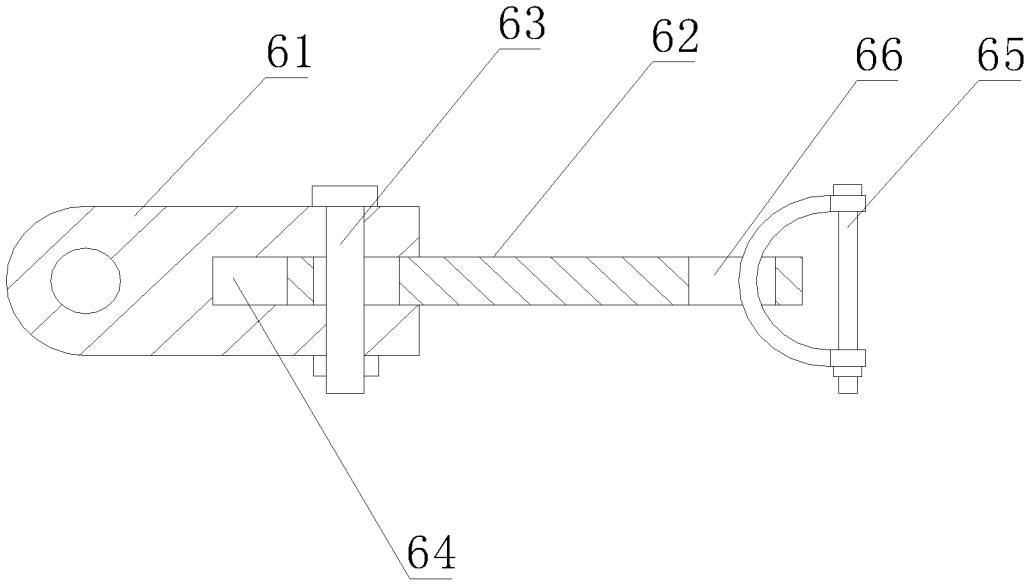
FIG. 6 is a structural schematic diagram of an angular linkage of the present disclosure.

In addition, as shown in FIG. 6, the angular linkage 6 comprises a steering head 61, a change-over board 62, and a D-shaped shackle 65, one end of the steering head 61 being movably connected with a fixed hold hoop 2, the other end thereof being provided with a limit groove 64, one end of the change-over board 62 being rotatably connected in the limit groove 64 via the second bolt assembly 63, the other end of the change-over board 62 being provided with a bar-shaped hole 66 for the D-shackle 65 to move, a connecting ring 57 connected to the D-shaped shackle 65 being provided on the first movable rod 52, and the connecting ring 57 and the first movable rod 52 being of an integral structure; the steering head 61 is rotatably connected to the fixed hold hoop 2 via the screw; the angular linkage 6 in this embodiment is convenient to mount and dismount as a whole and the connection is reliable; setting of the limit groove 64 may effectively limit the movable angle of the change-over board on the steering head 61, which enhances the safety performance of the entirety in use and may also improve the service life of the entirety; the D-shaped shackle 65 may implement a movable connection between the first movable rod 52 and the change-over board 62, and movement of the D-shaped shackle 65 is implemented through the bar-shaped hole 66 provided on the change-over board 62, such that when the first movable rod 52 moves up or down, it may simultaneously drive movement of the D-shaped shackle 65 on the change-over board 62, thereby implementing angular adjustment of the angle between the first movable rod 52 and the change-over board 62, which enables a convenient adjustment and a reliable connection; besides, setting of the connection ring 57 enables a fast assembly between the first movable rod 52 and the D-shaped shackle 65, which facilitates mounting and dismounting with a good use effect; setting the connection ring 57 and the first movable rod 52 into an integral structure may enhance the strength of the entirety, simplify the mounting process of the connection ring 57, and enhance the safety performance.

Figure 8:
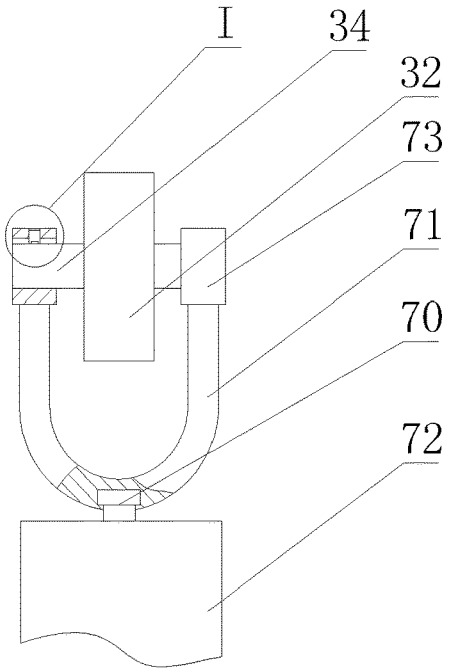
FIG. 8 is a structural schematic diagram of a hoisting assembly mounted with the supporting rod of the present disclosure.
Figure 9:
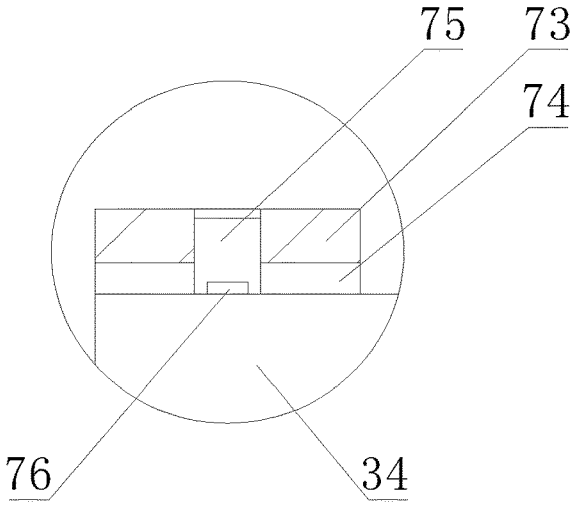
FIG. 9 is a locally enlarged view of I in FIG. 8.

Additionally, referring to FIGS. 8 and 9, the hoisting assembly 7 comprises a lifting u-shaped ring 71 and an electric hoist 72 disposed on the lifting u-shaped ring 71, the lifting u-shaped ring 71 being detachably connected with the supporting rod 3, a tension sensor 70 being provided on the lifting u-shaped ring 70. By mounting the electric hoist 72 onto the supporting rod 3 via the lifting u-shaped ring 71 so as to hoist the power equipment via the electric hoist 72, the hoisting efficiency is high; setting of the tension sensor 70 enables a real-time detection of the weight of the power equipment so as to prevent the supporting rod 3 from being broken due to a too heavy weight of the power equipment, which further improves the safety performance; and by setting the lifting u-shaped ring 71 and the supporting rod 3 to be detachably connected, it facilitates the operators to carry, thereby enabling on-site assembly, which provides a good practicality. A fixed shaft 34 is provided on the supporting rod 3, a fixed sleeve 73 is provided on the lifting u-shaped ring 71, an eccentric hole 74 is provided in the fixed sleeve 73, a locking screw 75 is provided on the fixed sleeve 73, and a bottom end of the locking screw 75 is provided with a magnet for pulling-in the fixed shaft 34, the fixed shaft 34 being mounted in the fixed sleeve 73 via the locking screw 75. In this embodiment, when mounting, through fitting between the fixed shaft 34 and the eccentric hole 74 inside the fixed sleeve 73, the lifting u-shaped ring 71 may be quickly mounted on the supporting rod 3; the eccentric ring 74 enables a fast mounting of the fixed shaft 34 and facilitates dismounting of the lifting u-shaped ring 71; the magnet 76 on the locking screw 75 pulls in the fixed shaft 34, causing the lifting u-shaped ring 71 to be tightened to the fixed shaft 34, which avoids detachment of the lifting u-shaped ring 71 from the fixed shaft 34 during the hoisting procedure and thereby improves the operating safety performance; besides, by providing the locking screw 75 on the fixed sleeve 34 via the magnet 76, pull-in and separation between the magnet 76 and the fixed shaft 34 may be quickly realized, such that the mounting process is simple, the use effect is good, and the pull-in steadiness between the magnet 76 and the fixed shaft 34 can be guaranteed.

Besides the preferred embodiments above, the present disclosure further has other embodiments. Those skilled in the art may make various alterations and transformations based on the present disclosure, which should all fall into the scope defined by the appended claims of the present disclosure without departing from the spirit of the present disclosure.

What is claimed is:

1. An improved portable distribution transformer hoisting rack, comprising: a loose-leaf hold hoop, a fixed hold hoop, a supporting rod, and a length-adjustable adjusting rod, wherein:

the loose-leaf hold hoop includes a first hold hoop, a second hold hoop, and a third hold hoop, the third hold hoop being disposed between the first hold hoop and the second hold hoop; the third hold hoop includes a first mounting portion and a second mounting portion, one end of the first hold hoop being mounted on the third hold hoop via the first mounting portion; a first gap is provided between the first hold hoop and the third hold hoop, one end of the second hold hoop being mounted on the third hold hoop via the second mounting portion; a second gap is provided between the second hold hoop and the third hold hoop; a first bolt assembly is provided between the other end of the first hold hoop and the other end of the second hold hoop, one end of the supporting rod being rotatably connected to the third hold hoop; the other end of the supporting rod being provided with a hoisting assembly for hoisting the power equipment, one end of the adjusting rod being movably connected to the supporting rod, and the other end of the adjusting rod being movably connected to the fixed hold hoop.

2. The improved portable distribution transformer hoisting rack according to claim 1, wherein the first mounting portion is a first mounting plate provided on the third hold hoop, a first fixing plate being provided on the first hold hoop, the first hold hoop being fixedly connected to the first mounting plate via the first fixing plate; and the second mounting portion is a second mounting plate provided on the third hold hoop, a second fixing plate being provided on the second hold hoop, the second hold hoop being fixedly connected to the second mounting plate via the second fixing plate.

3. The improved portable distribution transformer hoisting rack according to claim 1, wherein a radian of the first gap is equal to a radian of the second gap, and a central angle of the third hold hoop is 35-40°.

4. The improved portable distribution transformer hoisting rack according to claim 1, wherein a connecting bolt about which the supporting rod rotates is provided on the third hold hoop.

5. The improved portable distribution transformer hoisting rack according to claim 1, wherein the adjusting rod comprises a body and an angular linkage, one end of the body being movably connected to the supporting rod, the other end of the body being connected to the fixed hold hoop via the angular linkage.

6. The improved portable distribution transformer hoisting rack according to claim 5, wherein the body comprises: an adjusting portion, a first movable rod, and a second movable rod, the first movable rod being connected to one end of the adjusting portion via a positive thread, the second movable rod being connected to the other end of the adjusting portion via a negative thread.

7. The improved portable distribution transformer hoisting rack according to claim 6, wherein the adjusting portion comprises a tube body of a hollow structure, wherein one end of the tube body is provided with a positive thread hole, a positive thread fitted with the positive thread hole being provided on the first movable rod; the other end of the tube body is provided with a negative thread hole, a negative thread fitted with the negative thread hole being provided on the second movable rod; and the adjusting portion further comprises a nut facilitating the tube body to rotate, the nut being integrally formed with the tube body.

8. The improved portable distribution transformer hoisting rack according to claim 7, wherein the angular linkage including a steering head, a change-over board, and a D-shaped shackle, one end of the steering head being movably connected with the fixed hold hoop, the other end thereof being provided with a limit groove, one end of the change-over board being rotatably connected in the limit groove, the other end of the change-over board being provided with a bar-shaped hole for the D-shackle to move; and a connecting ring connected to the D-shaped shackle is provided on the first movable rod, the connecting ring and the first movable rod being of an integral structure.

9. The improved portable distribution transformer hoisting rack according to claim 1, wherein the hoisting assembly comprises a lifting u-shaped ring and an electric hoist disposed on the lifting u-shaped ring, the lifting u-shaped ring being detachably connected with the supporting rod, a tension sensor being provided on the lifting u-shaped ring.

10. The improved portable distribution transformer hoisting rack according to claim 9, wherein a fixed shaft is provided on the supporting rod, a fixed sleeve is provided on the lifting u-shaped ring, an eccentric hole is provided in the fixed sleeve, a locking screw is provided on the fixed sleeve, and a bottom end of the locking screw is provided with a magnet for pulling-in the fixed shaft, the fixed shaft being mounted in the fixed sleeve via the locking screw.

* * * * *